United States Patent [19]

Eick

[11] Patent Number: 4,904,214

[45] Date of Patent: Feb. 27, 1990

[54] MARINE STERN DRIVE WITH LUBRICATED AND SEALED OUTPUT COUPLER

[75] Inventor: Edward C. Eick, Stillwater, Okla.

[73] Assignee: Brunswick Corporation, Skokie, Ill.

[21] Appl. No.: 322,519

[22] Filed: Mar. 13, 1989

[51] Int. Cl.[4] ..... B63H 23/00

[52] U.S. Cl. ..... 440/83; 464/16

[58] Field of Search ..... 440/83, 111, 112, 113, 440/52, 64; 464/16, 92; 403/37, 39, 359; 184/5, 105.3, 28

[56] References Cited

U.S. PATENT DOCUMENTS

| | | | |
|---|---|---|---|
| 1,973,702 | 9/1934 | Cooke | 464/16 |
| 2,116,290 | 5/1938 | Spicer | 464/16 |
| 3,136,281 | 6/1964 | Kiekhaefer et al. | 440/11 |
| 3,242,695 | 3/1966 | Ross, Jr. | 464/16 |
| 4,634,391 | 1/1987 | Entringer et al. | 440/75 |
| 4,819,755 | 4/1989 | Smemo et al. | 464/16 |

*Primary Examiner*—Sherman D. Basinger
*Assistant Examiner*—Edwin L. Swinehart
*Attorney, Agent, or Firm*—Andrus, Sceales, Starke & Sawall

[57] ABSTRACT

A marine stern drive (10) has an engine output coupler (60) driven to rotate about an axis and having a hub (70) with a splined axial opening (72) therein which is open-ended at the front and rear. A splined output driveshaft (78) is received in the splined axial opening (72) of the coupler hub (70) and is operatively coupled to the boat propeller (20) to drive same. The coupler hub (70) has a grease fitting (74) therein and a grease passage (76) extending from the grease fitting (74) and communicating with the splines (80, 82) to lubricate same. Front and rear sealing O-rings (84, 86) trap and retain the grease therebetween to maintain lubrication of the splines. The axial opening in the hub has a forward splined section (88) and a rearward nonsplined section (90). The driveshaft has a forward nonsplined section (90), a splined section (94) axially rearward of the forward section (92), and another nonsplined section (96) axially rearward of the splined section (94). The driveshaft is received in the hub opening with the splined section of the driveshaft and the splined section of the hub opening partially overlapping. The forward nonsplined section (92) of the driveshaft is received in a portion of the splined section (88) of the hub opening forward of the overlapping splined sections. The splined section (94) of the driveshaft rearward of the overlapping splined sections is received in the nonsplined section (90) of the hub opening. The nonsplined section (96) of the driveshaft rearward of the splined section (94) of the driveshaft is also received in the nonsplined section (92) of the hub opening.

8 Claims, 3 Drawing Sheets

FIG. 3
PRIOR ART
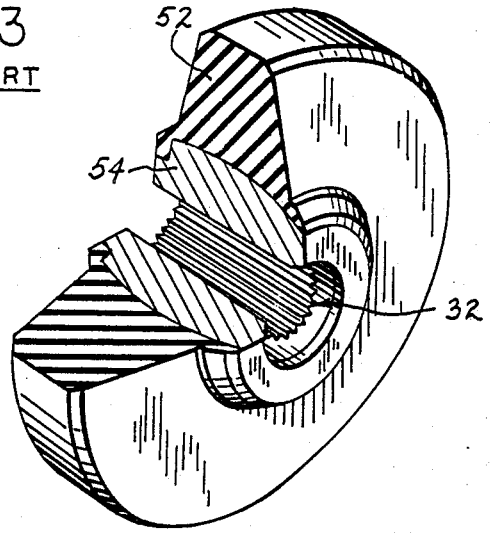
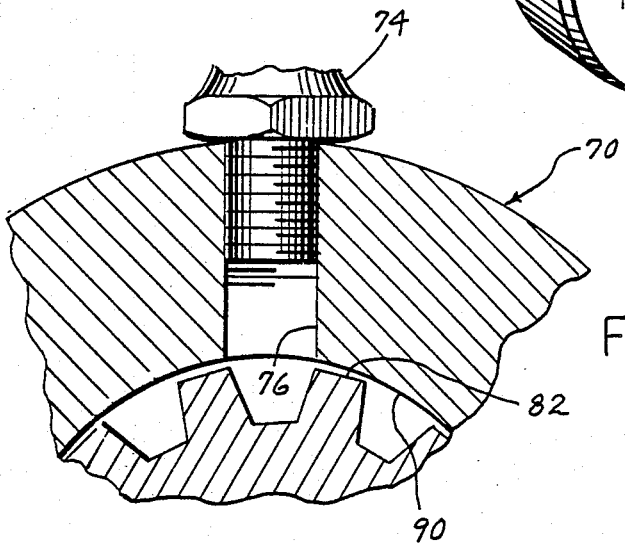
FIG. 6
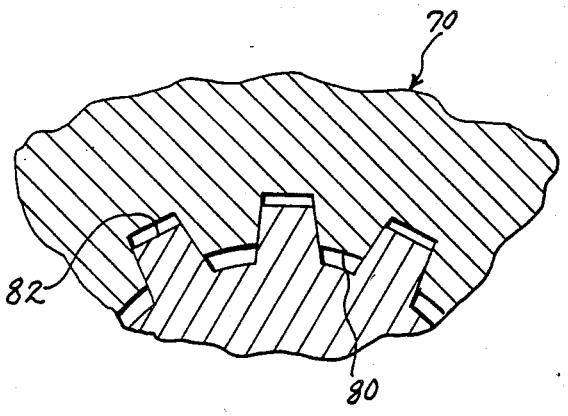
FIG. 7

MARINE STERN DRIVE WITH LUBRICATED AND SEALED OUTPUT COUPLER

BACKGROUND AND SUMMARY

The invention relates to marine stern drives, and more particularly to the output coupler such as in Entringer et al U.S. Pat. No. 4,634,391.

A marine stern drive has a lower outboard gearcase having a vertical driveshaft driving a horizontal propeller shaft in a lower torpedo housing, a propeller mounted on the propeller shaft and driven thereby, a universal joint driving the vertical driveshaft at the top of the gearcase, and an output driveshaft driving the universal joint and extending through the transom of a boat and having a forward splined end. An engine output coupler has an axially splined opening therein receiving the forward splined end of the output driveshaft. This structure has been subject to spline wear on commercial fishing boat engines due to lack of lubrication and continuous low speed operation. Periodic lubrication is required to prevent premature spline wear. Relubrication typically requires removal of the drive unit from the boat transom assembly, and then reinstallation. This is undesirable because it is costly, time consuming, and necessitates down time.

Some commercial boat operators have drilled an axial bore into the driveshaft, and radial cross holes with grease fittings for feeding grease into the bore, and plugging the end of the bore at the end of the driveshaft.

The present invention provides a simple and expedient solution to the above noted problem, without requiring drilling of bores in the driveshaft. The present invention provides lubrication structure which traps and retains the grease to maintain lubrication of the splines, preventing loss of lubricant as the splines slide against each other during normal boat trim and steering cycles. This significantly reduces the need for periodic relubrication. Another significant advantage of the invention is that it enables the boat operator himself to replenish the lubricant retention system without having to remove the drive unit from the boat, or remove the boat from the water. This significantly reduces servicing requirements, expense and down time.

Another solution is shown in commonly owned copending application Ser. No. 07/178,456, filed Apr. 7, 1988, "Marine Stern Drive With Lubricated Output Coupler".

BRIEF DESCRIPTION OF THE DRAWINGS

Prior Art

FIG. 3 is a perspective view partially cut away of the coupler of FIG. 2.

Present Invention

Figure 4:
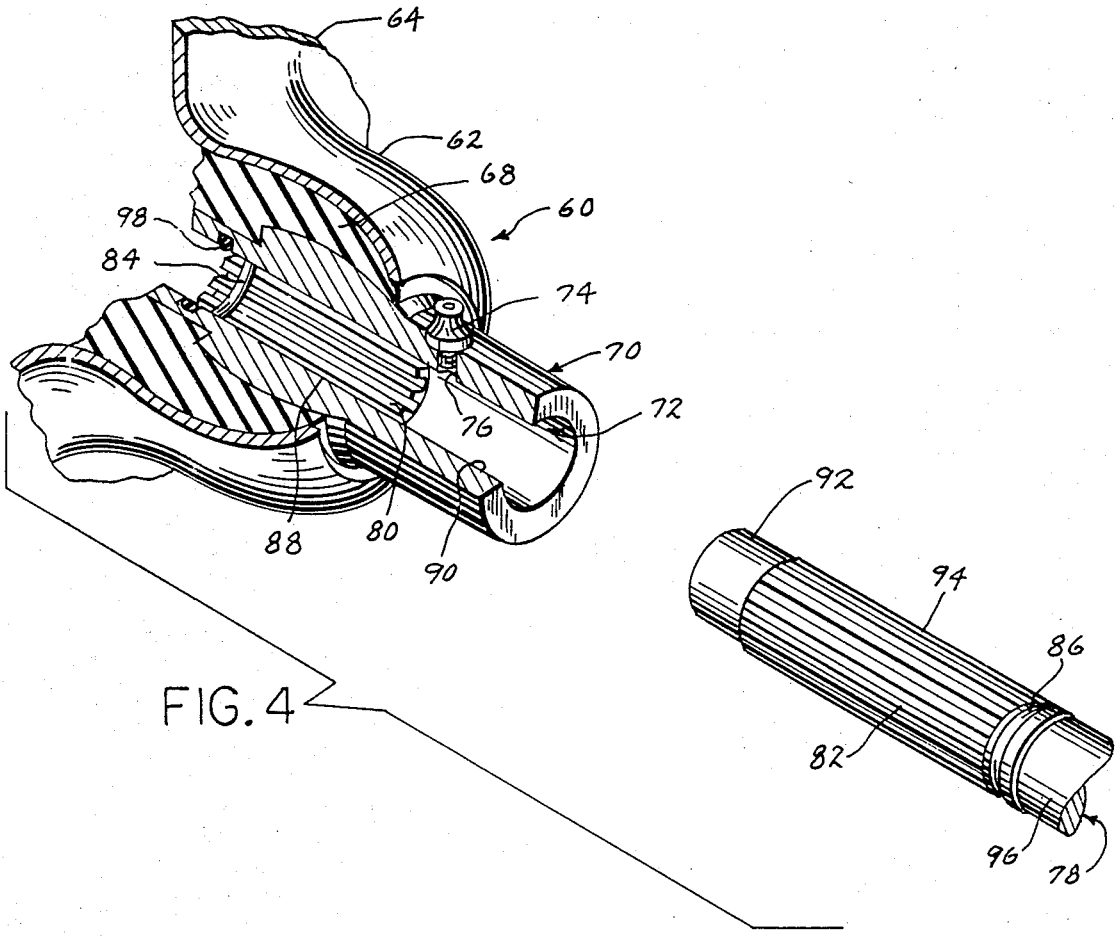

FIG. 4 is a perspective view partially cut away of a coupler and driveshaft separated therefrom, in accordance with the present invention.

Figure 5:
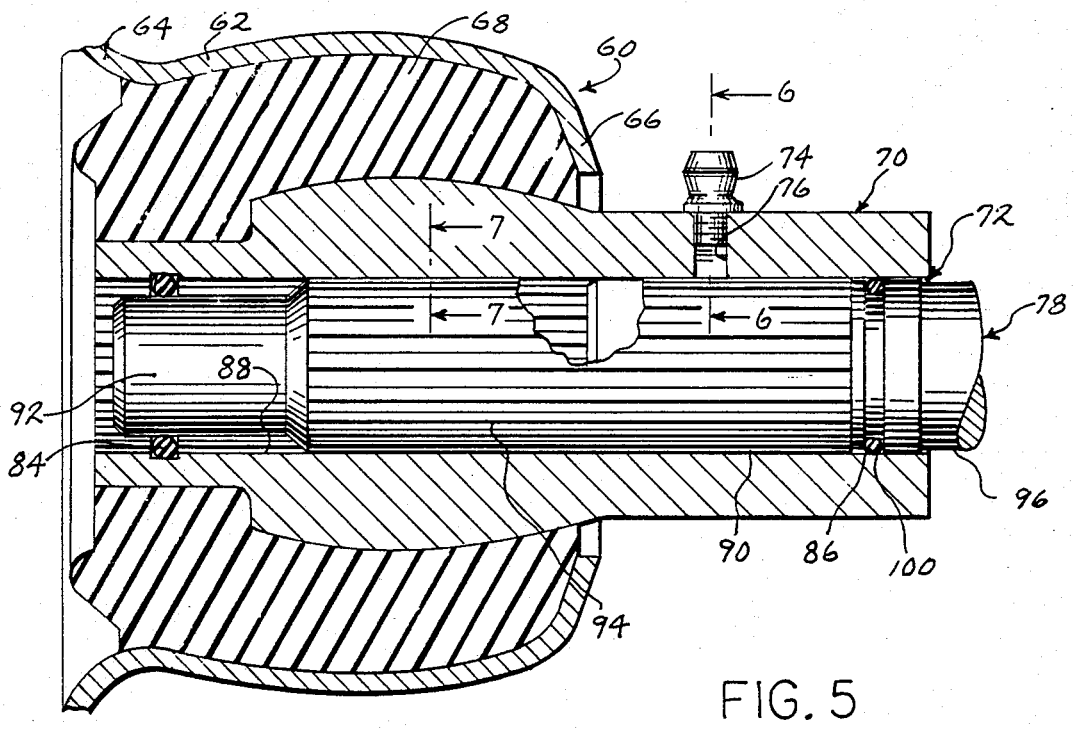

FIG. 5 is a sectional view of the coupler and driveshaft of FIG. 4, with the driveshaft inserted in the coupler.

FIG. 6 is a sectional view taken along line 6—6 of FIG. 5.

FIG. 7 is a sectional view taken along line 7—7 of FIG. 5.

DETAILED DESCRIPTION

Prior Art

Figure 1:
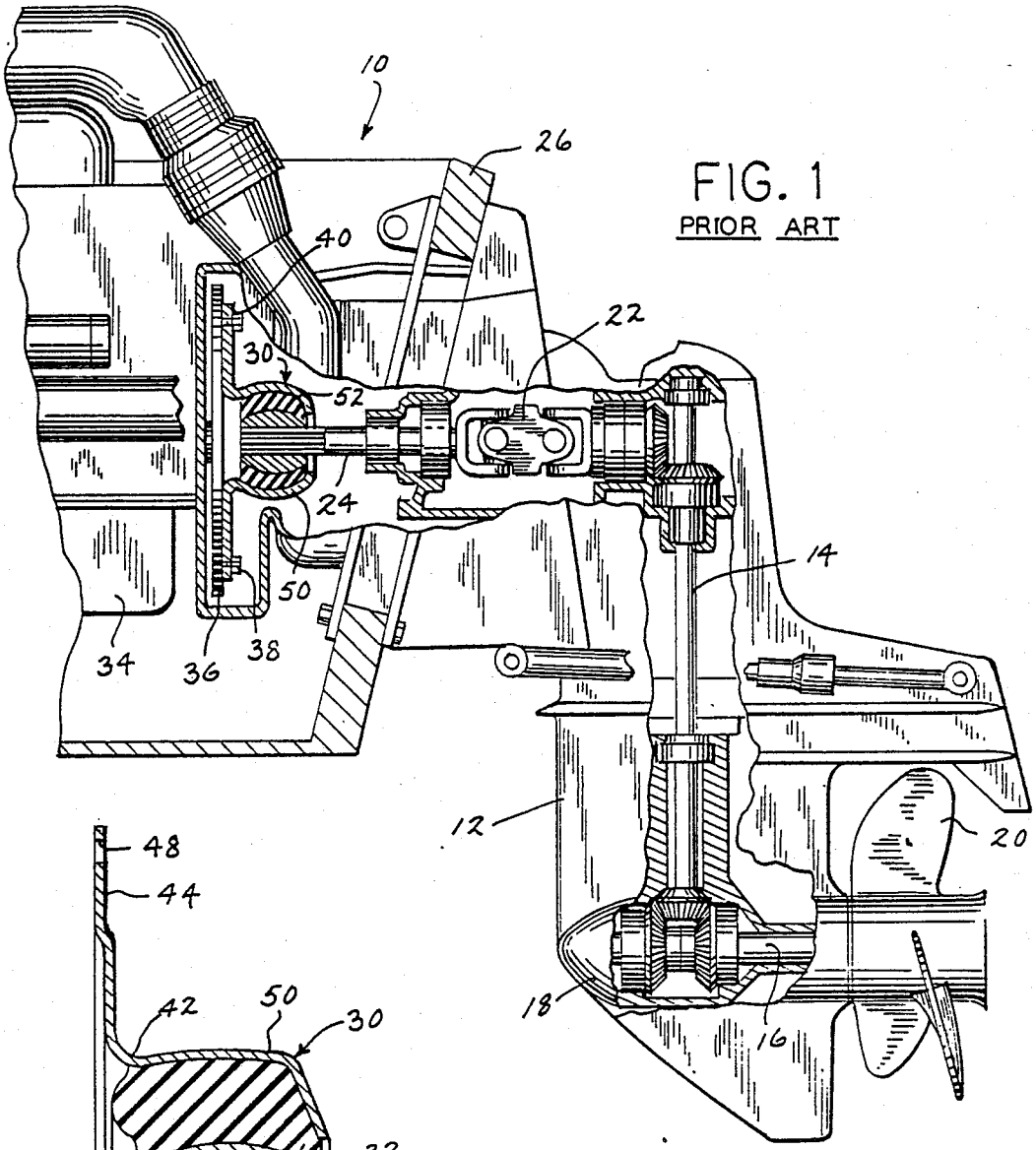
FIG. 1 PRIOR ART
FIG. 1 is a side view partially in section of a marine stern drive known in the prior art.

FIG. 1 shows a marine stern drive 10 including a lower outboard gearcase 12 having a vertical driveshaft 14 driving a horizontal propeller shaft 16 in a lower torpedo housing 18, and having a propeller 20 mounted on propeller shaft 16 and driven thereby. A universal joint 22 drives the vertical driveshaft at the top of the gearcase, and an output driveshaft 24 drives the universal joint and extends through the transom 26 of a boat. Output driveshaft 24 has a forward axially splined end 28, FIG. 2. An engine output coupler 30 has an axially splined opening 32 therein receiving forward splined end 28 of output driveshaft 24. Opening 32 is open-ended at both the forward (left) and rearward (right) ends thereof. Inboard internal combustion engine 34 has a flywheel 36 connected to coupler 30 by a plurality of peripheral bolts such as 38 and 40 around the circumference thereof. Engine 34 rotates flywheel 36 which drives and rotates coupler 30 to drive output shaft 24 to drive universal joint 22 to drive vertical driveshaft 14 to drive propeller shaft 16 to rotate propeller 20, all as is standard in the art.

Figure 2:
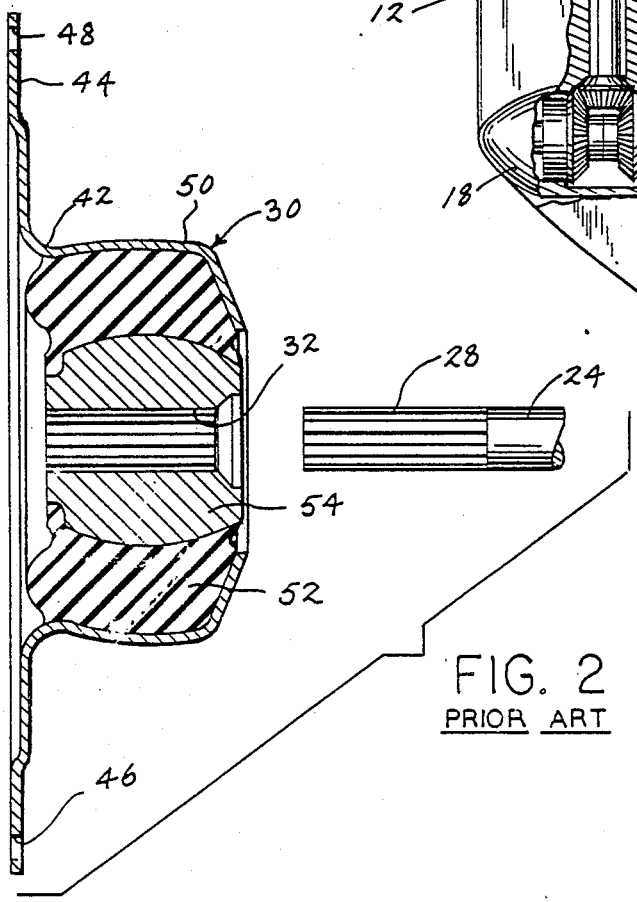
FIG. 2 PRIOR ART
FIG. 2 is an enlarged view of a portion of FIG. 1 showing the output driveshaft separated from the output coupler.

Coupler 30 includes an outer metal housing 42 with a peripheral circumferential flange 44 having a plurality of spaced apertures such as 46 and 48 circumferentially therearound for receiving bolts such as 38 and 40, to bolt metal housing 42 to flywheel 36. Housing 42 has a central raised top-hat-like portion 50 (extending rightwardly in FIG. 2) receiving a rubber insert 52 therein. Insert 52 is shown in FIG. 3 in its pre-deformed condition prior to insertion into housing portion 50. Upon such insertion, insert 52 deforms to the shape shown in FIG. 2. Coupler 30 also includes a central metal hub 54 having central axially splined opening 32. Coupler hub 54 is snuggly gripped by rubber insert 52 therearound in FIG. 3, and is more tightly gripped upon deformation of rubber insert 52 upon insertion into housing portion 50 as shown in FIG. 2. Rubber insert 52 allows some resilient give and shock absorbing capability in the connection to propeller 20.

Present Invention

FIGS. 4–7 show an output coupler and drive shaft in accordance with the invention. Coupler 60 includes an outer metal housing 62 with a peripheral circumferential flange 64 comparable to flange 44 and having a plurality of spaced apertures (not shown) circumferentially therearound for receiving bolts such as 38 and 40, to bolt metal housing 62 to flywheel 36. Housing 62 has a central raised top-hat-like portion 66, similar to portion 50 but of greater height, i.e. extending further rightwardly in FIG. 5 than the rightward extension of portion 50 in FIG. 2. Portion 66 receives a rubber insert 68 therein. Coupler 60 also includes a central metal hub 70 having central axially splined opening 72, which opening is open-ended at both the forward (left) and rearward (right) ends thereof. Coupler hub 70 is snuggly gripped by rubber insert 68 therearound prior to insertion of insert 68 into housing portion 66, and is more tightly gripped upon deformation of rubber insert 68 upon insertion into housing portion 66, all as similar to that described above. Rubber insert 68 allows some resilient give and shock absorbing capability in the connection to propeller 20. After insertion of insert 68 and hub 70 into housing 62, grease fitting 74 is threaded into radial bore 76 in hub 70. Splined output driveshaft 78 is received in splined axial opening 72 of coupler 60. Driveshaft 78 is operatively coupled to propeller 20 as above described for driving same.

Grease is introduced into coupler 60 at grease fitting 74. Grease passage 76 communicates with the splines 80 of the coupler and 82 of the output driveshaft to lubricate such splines. Front and rear seals are provided by axially spaced O-rings 84 and 86 trapping and retaining grease therebetween to maintain lubrication of the splines.

Axial opening 72 in hub 70 has a forward splined section 88 and a rearward nonsplined section 90. Driveshaft 78 has a forward nonsplined section 92, a splined section 94 axially rearward of forward section 92, and another nonsplined section 96 axially rearward of splined section 94. Driveshaft 78 is received in hub opening 72, with splined section 94 of the driveshaft and splined section 88 of the hub opening partially overlapping and in mating driving engagement. Forward nonsplined section 92 of the driveshaft is received in a portion of splined section 88 of the hub opening forward of the overlapping splined sections. The splined section 94 of the driveshaft rearward of the overlapping splined sections is received in nonsplined section 90 of the hub opening. The nonsplined section 96 of the driveshaft rearward of splined section 94 is also received in nonsplined section 90 of the hub opening. Grease passage 76 extends from grease fitting 74 and communicates with the hub opening to lubricate the overlapping splined sections.

The front seal provided by O-ring 84 is at the interface of the forward nonsplined section 92 of the driveshaft and the forward splined section 88 of the hub opening. The rear seal provided by O-ring 86 is at the interface of the nonsplined rearward section 96 of the driveshaft and the nonsplined rearward section 90 of the hub opening rearward of splined section 94 of the driveshaft. Seals 84 and 86 trap and retain grease therebetween to maintain lubrication of the splines. A reservoir is provided at forward nonsplined driveshaft section 92 rearward of seal 84, and another reservoir is provided at rearward nonsplined hub opening section 90 forward of seal 86.

Forward splined section 88 of the hub opening has an annular notch 98 extending therearound perpendicularly through the splines 80 and spaced axially forward of the overlapping splined sections. O-ring 84 is in notch 98 and encircles forward nonsplined section 92 of the driveshaft. O-ring 84 has a thickness greater than the spline tooth depth such that the inner periphery of the O-ring extends radially inwardly beyond the inner periphery of the teeth 80 of forward splined section 88 of hub opening 72. Nonsplined section 96 of the driveshaft rearward of splined section 94 has an annular notch 100 therein. O-ring 86 is in notch 100 and engages nonsplined rearward section 90 of hub opening 72. O-rings 84 and 86 grip the driveshaft and the hub opening and center the overlapping splined sections to reduce lash and provide uniform spline load distribution and maximum spline contact to reduce fretting wear.

To replenish grease, the boat operator merely introduces grease at fitting 74 which is communicated through passage 76 to nonsplined section 90 of the hub opening and the noted reservoir thereat and to the overlapping splined sections and to the noted forward reservoir at nonsplined driveshaft section 92. The seals provided by O-rings 84 and 86 substantially reduce loss of lubricant which may otherwise occur as the splines slide axially along each other during normal boat trim and steering cycles. The hub spline length and the shaft spline length as overlapped and as extending along nonsplined sections of each other enable such trim and steering operations necessary in a marine drive. The forward and rearward reservoirs provided by such structure further provide desirable reserve lubricant capacity.

Without periodic relubrication, the splines prematurely wear. The present invention significantly reduces the frequency of such periodic relubrication. The invention also enables the boat operator to relubricate the splines without having to remove the drive unit from the boat or remove the boat from the water. This significantly reduces servicing requirements, cost, and downtime for the boat operator.

It is recognized that various equivalents, alternatives and modifications are possible within the scope of the appended claims.

I claim:

1. A marine drive having an engine output coupler driven to rotate about an axis and having a splined axial opening therein extending along said axis and being open-ended at both the forward and rearward ends thereof, a splined output driveshaft received in said splined axial opening of said coupler and operatively coupled to a propeller for driving same, said coupler having a grease fitting for introducing grease therein and a grease passage extending from said grease fitting and communicating with said splines to lubricate the latter, front and rear axially spaced seals trapping and retaining said grease therebetween to maintain lubrication of said splines; said coupler comprises a hub having said axial opening therethrough, said opening and said driveshaft having axially overlapping splined sections in mating driving engagement, said front seal is spaced axially forward of said overlapping splined sections, said rear seal is spaced axially rearward of said overlapping splined sections, a forward portion of at least one of said driveshaft and said hub opening has a nonsplined section axially between said front seal and said overlapping splined sections, and wherein rearward portion of at least one of said driveshaft and said hub opening has a nonsplined section axially between said rear seal and said overlapping splined sections.

2. The invention according to claim 1 wherein said grease passage extends between said grease fitting and said last mentioned nonsplined section.

3. The invention according to claim 1 wherein said forward portion of said hub opening is splined and said forward portion of said driveshaft is nonsplined such that said nonsplined section axially between said front seal and said overlapping splined sections is provided by said driveshaft, and wherein said rearward portion of said hub opening is nonsplined and said rearward portion of said driveshaft is splined such that said nonsplined section axially between said rear seal and said overlapping splined sections is provided by said hub opening.

4. The invention according to claim 1 comprising a forward annular notch in one of said driveshaft and said hub opening and spaced axially forward of said overlapping splined sections, a rearward annular notch in one of said driveshaft and said hub opening and spaced axially rearward of said overlapping splined sections, and wherein said front seal comprises an O-ring received in said forward notch, said rear seal comprises an O-ring received in said rearward notch, said O-rings gripping said driveshaft and said hub opening and centering said overlapping splined sections to reduce lash and provide uniform spline load distribution and maximum spline contact to reduce fretting wear.

5. The invention according to claim 4 wherein said forward notch is in said hub opening, and said rearward notch is in said driveshaft.

6. A marine drive having an engine output coupler driven to rotate about an axis, said coupler having a hub with an axial opening therein, said axial opening having a forward splined section and a rearward nonsplined section, an output driveshaft received in said axial opening of said hub and operatively coupled to a propeller for driving said propeller, said driveshaft having a forward nonsplined section, a splined section axially rearward of said forward section, and another nonsplined section axially rearward of said splined section, said driveshaft received in said hub opening with said splined section of said driveshaft and said splined section of said hub opening partially overlapping and in mating driving engagement, said forward nonsplined section of said driveshaft being received in a portion of said splined section of said hub opening forward of said overlapping splined sections, said splined section of said driveshaft rearward of said overlapping splined sections being received in said nonsplined section of said hub opening, said nonsplined section of said driveshaft rearward of said splined section of said driveshaft also being received in said nonsplined section of said hub opening, said hub having a grease fitting for introducing grease therein and a grease passage extending from said grease fitting and communicating with said hub opening to lubricate said overlapping splined sections, a first seal at the interface of said forward nonsplined section of said driveshaft and said forward splined section of said hub opening, a second seal at the interface of said nonsplined rearward section of said driveshaft and said nonsplined rearward section of said hub opening rearward of said splined section of said driveshaft, said seals trapping and retaining said grease therebetween to maintain lubrication of said splines.

7. The invention according to claim 6 comprising an annular notch in said forward splined section of said hub opening extending around said opening perpendicularly through the splines and spaced axially forward of said overlapping splined sections, and wherein said front seal comprises an O-ring in said notch encircling said forward nonsplined section of said driveshaft, said O-ring having a thickness greater than the spline tooth depth of said forward splined section of said hub opening such that the inner periphery of said O-ring extends radially inwardly beyond the inner periphery of the teeth of said forward splined section of said hub opening.

8. The invention according to claim 7 comprising an annular notch in said driveshaft around said nonsplined section rearward of said splined section of said driveshaft, and wherein said rear seal comprises an O-ring in said last mentioned notch and engaging said nonsplined rearward section of said hub opening.

* * * * *